US008064811B2

(12) United States Patent
Sato et al.

(10) Patent No.: US 8,064,811 B2
(45) Date of Patent: Nov. 22, 2011

(54) IMAGE FORMING APPARATUS HAVING MISREGISTRATION CORRECTION OF THE TONER IMAGE FORMED BY EACH IMAGE FORMING UNIT

(75) Inventors: Yuji Sato, Saitama (JP); Takashi Kubo, Saitama (JP); Hajime Misumi, Saitama (JP); Fujio Osawa, Saitama (JP); Hideo Kageyama, Saitama (JP); Mitsunori Shioi, Saitama (JP); Kanou Saitou, Saitama (JP); Susumu Takagaki, Saitama (JP); Tadakazu Tsutehira, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 9 days.

(21) Appl. No.: 12/540,805

(22) Filed: Aug. 13, 2009

(65) Prior Publication Data

US 2010/0226695 A1 Sep. 9, 2010

(30) Foreign Application Priority Data

Mar. 5, 2009 (JP) ..... 2009-052159

(51) Int. Cl.
*G03G 15/01* (2006.01)

(52) U.S. Cl. ..... 399/301; 347/116

(58) Field of Classification Search ..... 399/49, 399/60, 72, 301; 347/116
See application file for complete search history.

(56) References Cited

U.S. PATENT DOCUMENTS

| | | | | |
|---|---|---|---|---|
| 2006/0233561 | A1 | 10/2006 | Yamaoka | |
| 2006/0275057 | A1* | 12/2006 | Suzuki | 399/301 |
| 2006/0285863 | A1* | 12/2006 | Noguchi et al. | 399/49 |
| 2007/0274745 | A1* | 11/2007 | Ueda et al. | 399/301 |

FOREIGN PATENT DOCUMENTS

| | | |
|---|---|---|
| JP | A-2000-206761 | 7/2000 |
| JP | A-2003-295560 | 10/2003 |
| JP | A-2004-177507 | 6/2004 |
| JP | A-2006-293240 | 10/2006 |

OTHER PUBLICATIONS

Feb. 22, 2011 Office Action issued in Japanese Patent Application No. 2009-052159 (with translation).

* cited by examiner

*Primary Examiner* — David Porta
*Assistant Examiner* — Miton Gonzalez
(74) *Attorney, Agent, or Firm* — Oliff & Berridge, PLC

(57) ABSTRACT

An image forming apparatus includes a plurality of image forming units that form toner images in different color; an image carrier which carries the toner image of each color; a determination unit that determines, in relation to a size of image data instructed to print, whether or not a first area where a misregistration correcting image is formed at an end portion in a width direction of the image carrier is secured; a first control unit that controls the image forming unit; and a detection sensor that detects the misregistration correcting image formed on the image carrier by controlling of the first control unit; wherein the misregistration of the toner image formed by each image forming unit is corrected on a basis of a value detected by the detection sensor.

3 Claims, 5 Drawing Sheets

IMAGE FORMING APPARATUS HAVING MISREGISTRATION CORRECTION OF THE TONER IMAGE FORMED BY EACH IMAGE FORMING UNIT

CROSS-REFERENCE TO RELATED APPLICATION

This application is based on and claims priority under 35 USC 119 from Japanese Patent Application No. 2009-052159 filed on Mar. 5, 2009.

BACKGROUND

1. Technical Field

The present invention relates to an image forming apparatus.

2. Related Art

As an image forming apparatus which performs color printing, there is a tandem type apparatus which includes, for each color, an image forming part (a photoconductor, an exposure device, and the like) that transfers a toner image of each color onto paper.

In this tandem type image forming apparatus, the image forming part for each color (Y (yellow), M (magenta), C (cyan) and K (black) performs a printing operation onto a paper sheet, and a color image is formed by toner images of four colors.

Therefore, in case that transfer timing onto a transfer belt is slightly different among the image forming parts for the respective colors due to change of temperature and change with time, printing is performed in a state where only a specified color in one image is misaligned, so that a so-called misregistration arises.

As technology of registration adjustment for correcting this misregistration, there is technology in which an image forming part for each color forms on a transfer belt a registration adjustment patch, a sensor detects the amount of deviations in the position of each color registration adjustment patch on the transfer belt from a reference position, and the writing timing at the image forming part is changed so that the amount of this misregistration can be eliminated.

SUMMARY

According to an aspect of the invention, an image forming apparatus includes a plurality of image forming units that form toner images in different color; an image carrier to which the toner image of each color formed by each image forming unit is transferred and which carries the toner image of each color; a determination unit that determines, in relation to a size of image data instructed to print, whether or not a first area where a misregistration correcting image is formed at an end portion in a width direction of the image carrier is secured; a first control unit that controls the image forming unit, in case that the determination unit has determined that the first area is secured, so as to form the misregistration correcting image for correcting a misregistration of the toner image formed by each image forming unit, in a second area on the image carrier where a recording medium is not contacted; and a detection sensor that detects the misregistration correcting image formed on the image carrier by controlling of the first control unit; wherein the misregistration of the toner image formed by each image forming unit is corrected on a basis of a value detected by the detection sensor.

BRIEF DESCRIPTION OF THE DRAWINGS

Exemplary embodiments of the invention will be described in detail based on the following figures, wherein.

DETAILED DESCRIPTION

Firstly, the constitution of an image forming apparatus 1 will be described with reference to FIG. 1.

Figure 1:
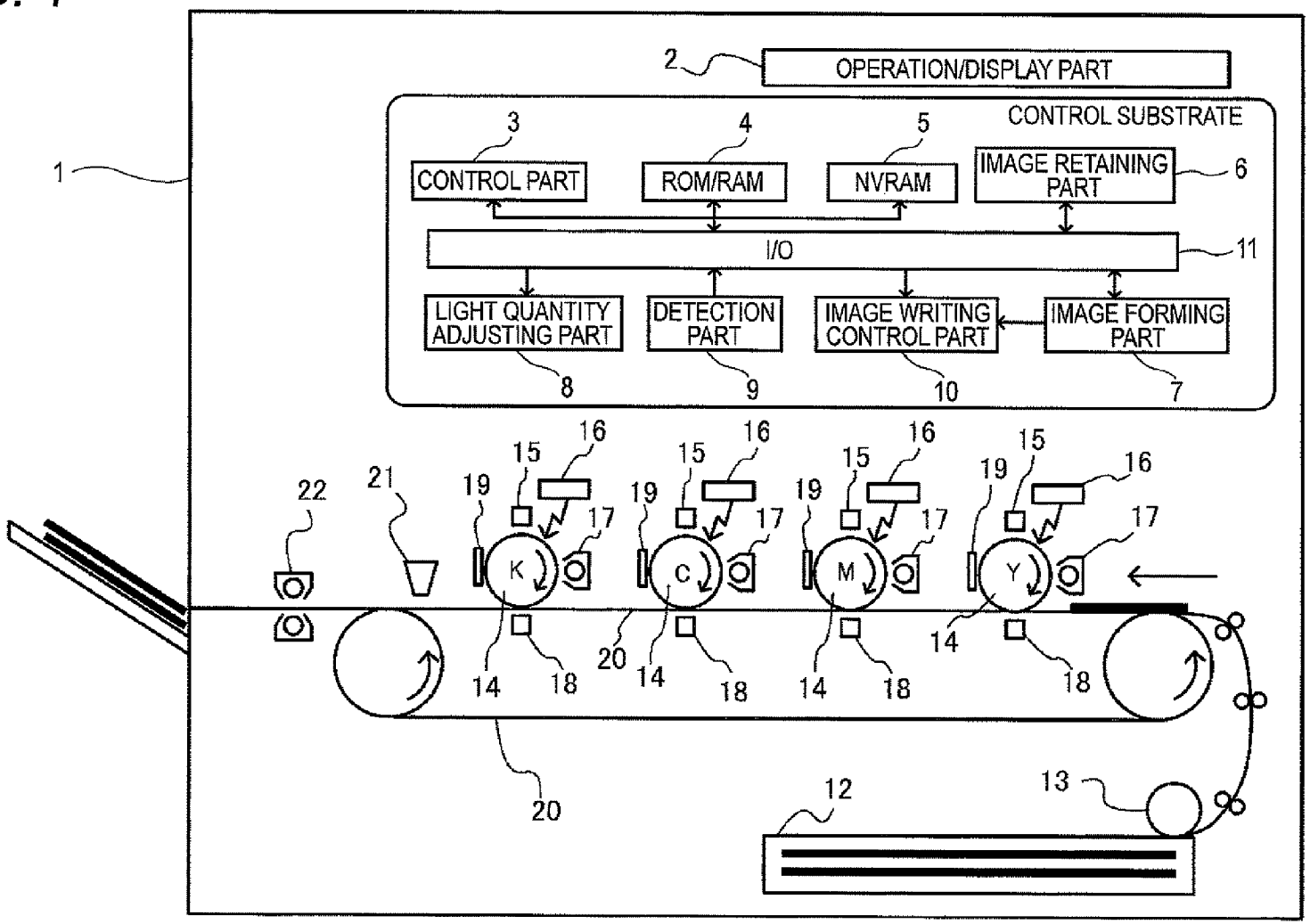
FIG. 1 is a schematic diagram showing the functional constitution of an image forming apparatus 1.

FIG. 1 is a diagram showing the constitution of the image forming apparatus 1.

The image forming apparatus 1, as shown in FIG. 1, includes a display/operational part 2, a control part 3, a ROM (Read Only Memory)/RAM (Random Access Memory) 4, a NVRAM (Non Volatile Random Access Memory) 5, an image retaining part 6, an image forming part 7, a light quantity adjusting part 8, a detecting part 9, an image writing control part 10, an input/output port 11, a paper supply tray 12, a pick-up roller 13, a photoconductor 14, a charging unit 15, an exposure unit 16, a development unit 17, a transfer unit 18, a cleaner 19, a transfer-transport belt 20, a patch detection sensor 21, and a fixing unit 22.

Further, the image forming apparatus 1 is, as shown in FIG. 1, a tandem type image forming apparatus which includes image forming parts for Y (yellow), M (magenta), C (cyan), and K (black). The image forming part for each color includes the photoconductor 14, the charging unit 15, the exposure unit 16, the development unit 17, the transfer unit 18, and the cleaner 19.

The display/operational part 2 is a user interface of a touch panel type, which displays information for user, and also receives an instruction from the user.

The control part 3 is composed of a CPU (Central Processing Unit), which performs overall control of the image forming apparatus 1.

Further, the control part 3 compares the size of paper used in printing of a print job with an image formable area by the photoconductor 14, and determines whether or not there is at an end in the width direction of the transfer-transport belt 20 an area where a registration adjustment patch is formed.

The ROM/RAM 4 includes a ROM and a RAM. The ROM functions as a work area which stores therein a firmware for operating the image forming apparatus 1, and the RAM functions as a work area which stores therein various information for controlling the operation of the apparatus, such as system data.

The NVRAM stores the number that a print counter indicates.

The image retaining part 6 performs a spool function of retaining the print job. The print job is transmitted from a print job transmission terminal of a not-shown personal computer, sent to the image forming apparatus 1 through a communication line interconnecting its print job transmission terminal and the image forming apparatus 1, and received by a not-shown communication interface of the image forming apparatus 1.

The image forming part 7 forms a bit map image on which an instruction is given by the print job.

The light quantity adjusting part 8 adjusts the quantity of light irradiated by the patch detection sensor 21 in order to detect a registration adjustment patch.

The detection part 9, upon reception of data received by the patch detecting sensor 21, detects a registration adjustment patch.

The image writing control part 10, in order to print the bit map image formed by the image forming part 7, controls the exposure unit 16, the development unit 17 and the like so that electrostatic latent images are formed on the photoconductors for Y-color, M-color, C-color, and K-color to form toner images.

The input/output port 11 is a port through which the control part 3 receives or transmits the data.

As described below, the registration adjustment patches of the respective colors formed onto the transfer-transport belt 20 are formed by transferring onto the transfer-transport belt 20 the toner images formed on the photoconductors 14 for the Y, M, C, and K-colors by the control by the image writing control part 10.

The paper supply tray 12 accommodates paper on which an image is to be formed.

The pick-up roller 13 feeds out the paper accommodated in the paper supply tray 12 toward the transfer-transport belt 20.

On the photoconductor 14, an electrostatic latent image is formed by the exposure unit and next a toner image is formed by the development unit 17 to be transferred to paper.

The charging unit 15 charges uniformly the circumferential surface of the photoconductor 14.

The exposure unit 16 is composed of a semiconductor laser and a polygon mirror for deflection-scanning laser beams, and forms an electrostatic latent image on the photoconductor 14.

The development unit 17 develops the electrostatic latent image formed on the photoconductor 14 with toner, thereby to form a toner image on the photoconductor 14.

The transfer unit 18 transfers the toner image formed on the photoconductor 14 onto paper transported on the transfer-transport belt 20.

The cleaner 19 cleans the residual toner remaining on the photoconductor 14 after transfer of the toner image onto the paper.

The transfer-transport belt 20 transports the paper, on which the toner image is transferred onto the paper.

Then, on the transfer-transport belt 20, registration adjustment patches are formed respectively by the respective photoconductors 14 for the Y, M, C and K-colors.

The patch detection sensor 21 is composed by a not-shown light emission part and a not-shown light reception part, the quantity of light irradiated onto the transfer-transport belt 20 by the light emission part is adjusted by the light quantity adjusting part 8, and the data received by the light reception part is sent to the detection part 9.

On the basis of processing by the light quantity adjusting part 8, the detection part 9, and the patch detection sensor 21, the registration adjustment patches formed on the transfer-transport belt 20 are detected.

The fixing unit 22 performs an operation of fixing an unfixed toner image carried on the paper onto paper.

In the thus constructed image forming apparatus 1, the toner images of the respective colors are formed by the photoconductors 14 for the respective colors of Y, M, C and K. However, due to variation in the units for the respective colors, misregistration arises.

Therefore, in the image forming apparatus 1, a registration adjustment patch is formed on the transfer-transport belt 20 by each image forming part, and the registration adjustment patch is detected by the patter detection sensor 21, whereby misregistration in a patch of each color is measured.

Next, the image writing control part 10 performs the control of writing timing to the exposure unit 16 so that the measured amount of the misregistration can be corrected.

The registration adjustment for correcting the misregistration is thus performed. The registration adjustment in the image forming apparatus 1 is performed in the following cases: while a printing operation of forming an image on the paper transported onto the transfer-transport belt 20 is being performed, the registration adjustment is performed; and under a state where the paper is not transported onto the transfer-transport belt 20, the print operation is interrupted and the registration adjustment is performed.

Whether the printing operation is interrupted for the purpose of the registration adjustment or not is determined by the size of paper on which the printing operation of the print job is to be performed.

Next, the width of paper in case that the print operation does not need the interruption for the purpose of the registration adjustment will be described with reference to FIG. 2.

Figure 2:
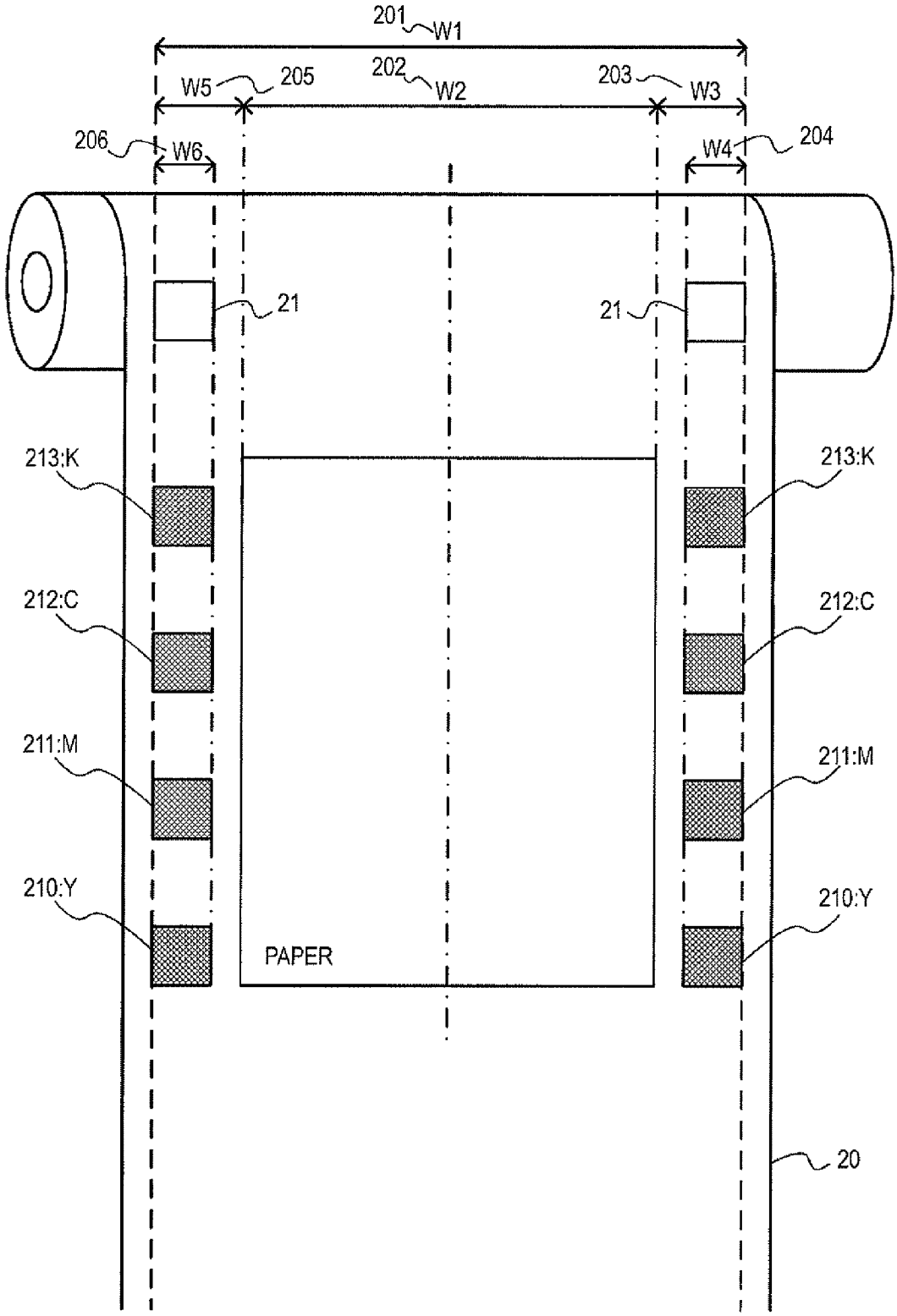
FIG. 2 is a diagram showing a registration adjustment patch which performs registration adjustment without interrupting a printing operation.

FIG. 2 shows a schematic diagram showing the width of paper which does not need interruption of the printing operation for the registration adjustment, and a registration adjustment patch formed on the transfer-transport belt 20 in that time.

As shown in FIGS. 1 and 2, the patch detection sensors 21 for detecting the registration adjustment patches on the transfer-transport belt 20 exist near ends in the width direction of the transfer-transport belt 20.

Further, as shown in FIG. 2, the width of an image formable area by the image forming apparatus 1 is a width W1 (refer to a reference numeral 201) of the transfer-transport belt 20.

The width of paper to be transported is a width W2 (refer to a reference numeral 202). The width W2 of the paper is a width orthogonal to the transport direction of the paper transported on the transfer-transport belt 20.

Therefore, in the image formable area, unused areas which are not used in printing on the paper exist the ends in the width direction of the transfer-transport belt 20, and widths of their areas are a width W3 (refer to a reference numeral 203) and a width W5 (refer to a reference numeral 205).

Further, in the image forming apparatus 1, the width of the registration adjustment patch necessary for the registration adjustment is a width W4 (refer to a reference numeral 204) and a width W6 (refer to a reference numeral 206).

In case of paper in which the width W3, W5 of the unused area becomes wider than the width of the registration adjustment patch, the registration adjustment patch is formed in the unused area, and the printing operation on the paper is performed in the used area.

In case that the areas (W6 and W4) where the registration adjustment patches are thus formed are secured at the ends in the width direction of the transfer-transport belt 20, the registration adjustment can be performed without interrupting the printing operation.

The registration adjustment patches (reference numerals 210, 211, 212, and 213) to be formed on the transfer-transport belt 20 are, as shown in FIG. 2, formed in the unused areas (W3 and W5) in the range of the image formable area (W1) which remain unused in printing on the paper.

A registration adjustment patch for Y-color (reference numeral 210) is formed by the photoconductor 14 that performs printing for Y-color, a registration adjustment patch for M-color (reference numeral 211) is formed by the photoconductor 14 that performs printing for M-color, a registration adjustment patch for C-color (reference numeral 212) is formed by the photoconductor 14 that performs printing for C-color, and a registration adjustment patch for K-color (reference numeral 213) is formed by the photoconductor 14 that performs printing for K-color.

Regarding the thus formed registration adjustment patches, the position of the registration adjustment patch for each color is detected by the patch detection sensor 21.

On the basis of the detected position of the registration adjustment patch for each color, the amount of the misregistration in the required directions such as a sub-scanning direction and a main scanning direction is detected by the detection part 9, and correction of the amount of the misregistration is reflected soon in the next printing operation.

Further, since the registration adjustment patches (reference numerals 210, 211, 212, and 213) are formed on the transfer-transport belt 20, frequency of a toner band printed in a non-print area in order to prevent abrasion in case that continuous printing is usually performed on only narrow paper is reduced, so that it is possible to suppress consumption of the toner.

Next, the width of paper in which the printing operation is interrupted for the purpose of the registration adjustment will be described with reference to FIG. 3.

Figure 3:
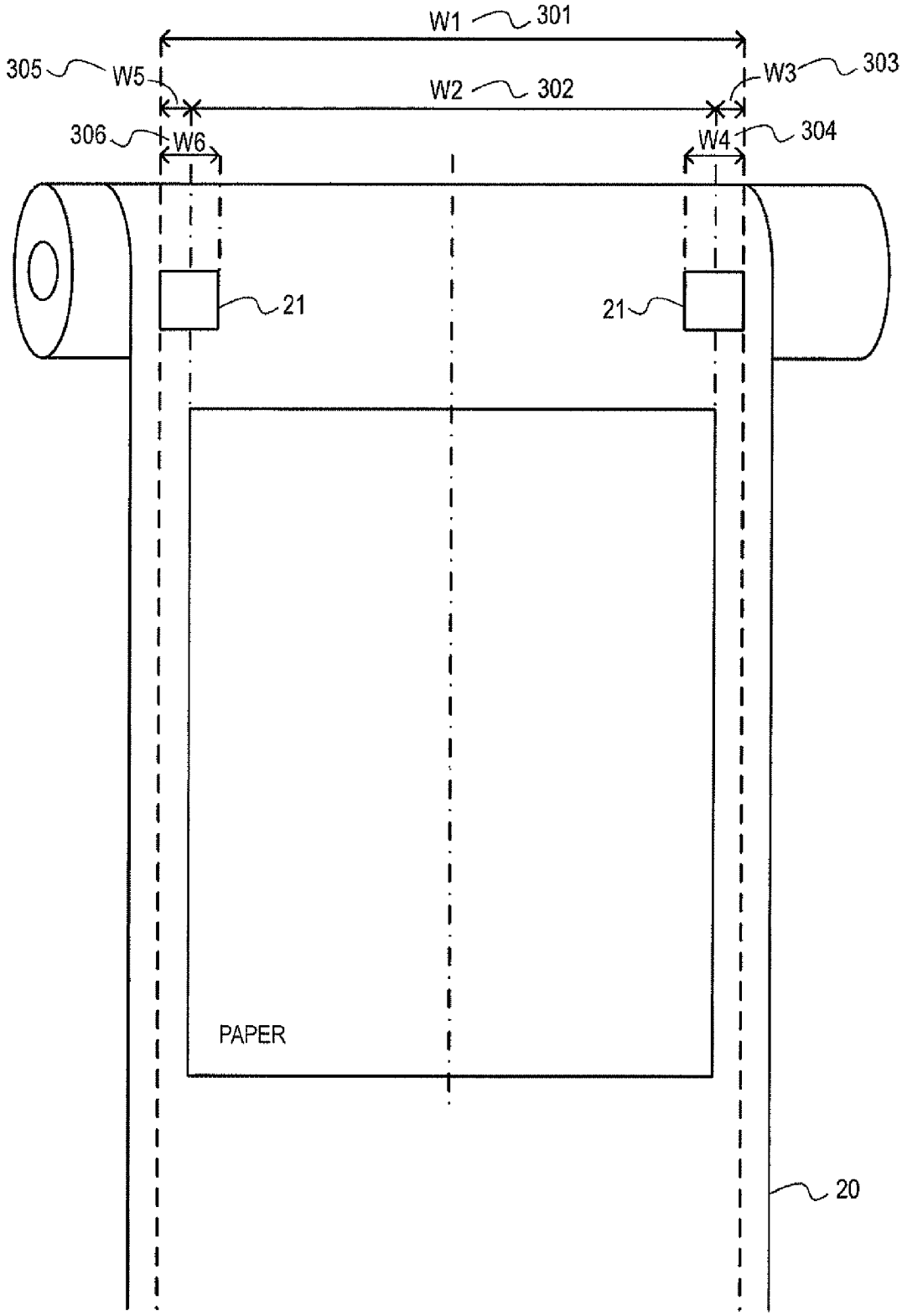
FIG. 3 is a diagram showing paper on which the printing operation is interrupted for the purpose of registration adjustment.

FIG. 3 is a schematic diagram showing the width of paper requiring the interruption of the printing operation for the purpose of the registration adjustment, and the transfer-transport belt 20.

In case that the width W2 (reference numeral 302) of paper on which the printing operation is to be performed is wide to a degree, as shown in FIG. 3, in the image formable area, the width W3 (reference numeral 303) and the width W5 (reference numeral 305) in the unused areas existing the ends in the width direction of the transfer-transport belt 20 become narrower than the width W4 (refer to reference numeral 304) and the width W6 (refer to reference numeral 306) of the registration adjustment patch necessary for the registration adjustment.

Thus, in case that the width W3 and the width W5 in the unused areas existing the ends in the width direction of the transfer-transport belt 20 become narrower than the widths W4 and W6 of the registration adjustment patches, it is impossible to form the registration adjustment patches on the transfer-transport belt 20 so as to be detected by the patch detection sensor 21. Therefore, while the printing operation is being continued, the registration adjustment cannot be performed. In such the case, the registration adjustment, after the printing operation on the paper has been interrupted, is performed.

Next, processing performed by the image forming apparatus 1 will be described with reference to FIG. 4.

Figure 4:
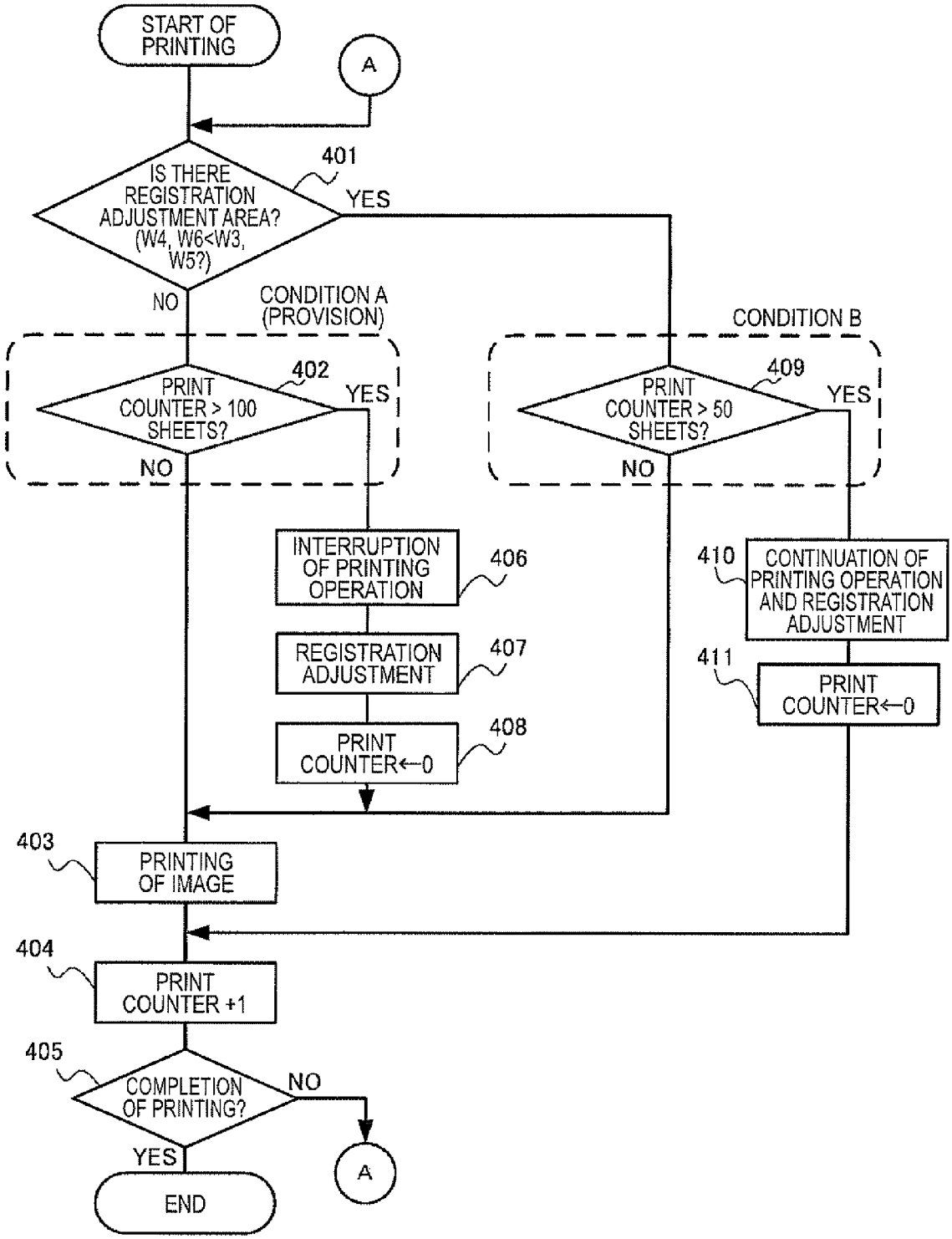
FIG. 4 is a flowchart showing processing in the image forming apparatus 1.

FIG. 4 is a flowchart showing the processing performed by the image forming apparatus 1.

When printing of a print job is started in the image forming apparatus 1, on the basis of contents of the print job and the width of paper used in that printing, widths W3 and W5 which are unused areas in the image formable area W1 (see reference numeral 301 in FIG. 3) that remain unused in printing on the paper are calculated by the control part 3.

Then, whether or not the widths W3 and W5 are wider than the widths W4 and W6 of the registration patches (W3<W4 and W5<W6?) is determined by the control part 3 (step 401).

In case that it is determined in the step 401 that the widths W3 and W5 are not wider than the widths W4 and W6 of the registration patch (No in the step 401), the registration adjustment is not performed in a state where the printing operation is continued but the registration adjustment is performed in a state where the printing operation is interrupted.

Next, the control part 3 determines in accordance with the following condition A whether or not the registration adjustment is performed in the state where the printing operation is interrupted.

Namely, the control 3 determines whether or not the number that the print counter indicates is over 100 sheets (condition A) (step 402).

The print counter is a counter which counts the number of paper sheets on which images have been formed.

The control part 3 makes the decision on the condition A; and in case that the print counter does not exceed 100 sheets (No in the step 402), image formation on one paper sheet is performed (step 403).

When the image formation on one paper sheet is completed, the number counted by the print counter is increased by [1] (step 404).

The data of the print counter is stored in the NVRAM 5.

Successively, printing is continued (No in the step 405), and printing in which the widths W3 and W5 are not wider than the widths W4 and W6 of the registration adjustment patches (No in the step 401) is performed. Herein, in case that the print counter exceeds the 100 sheets (Yes in the step 402), it is determined that such the case corresponds to the condition A; the printing operation on the paper is interrupted (step 406); and registration adjustment patches are formed on the transfer-transport belt 20 to perform the registration adjustment (step 407).

After the registration adjustment, the print counter is returned to [0] (step 408), and thereafter the printing operation on one paper sheet is performed (step 403).

Further, in case that it is determined in the step 401 that the widths W3 and W5 which are unused areas in the image formable area W1 which remain unused in printing on the paper are wider than the widths W4 and W6 of the registration patches (Yes in the step 401), the registration adjustment is performed in a state where the printing operation is continued.

Then, the control part 3 determines in accordance with the following condition B whether or not the registration adjustment is performed in the state where the printing operation is continued.

Namely, the control 3 determines whether the print counter exceeds 50 sheets or not (condition B) (step 409).

The control part 3 makes the decision on the condition B; and in case that the print counter does not exceed 50 sheets (o in the step 409), image formation on one paper sheet is performed (step 403).

When the image formation on one paper sheet is completed, the number counted by the print counter is increased by [1] (step 404).

Successively, printing is continued (No in step the 405), and printing in which the widths W3 and W5 are wider than the widths W4 and W6 of the registration adjustment patches (Yes in the step 401) is performed. Herein, in case that the print counter exceeds the 50 sheets (Yes in the step 409), it is determined that such the case corresponds to the condition B; while the printing operation on the paper is being continued, registration adjustment patches described with reference to FIG. 2 are formed on the transfer-transport belt 20 thereby to perform the registration adjustment (step 410).

After the printing operation on the paper, and the registration adjustment while continuing the printing operation on the paper have been performed in the step 410, the print counter is returned to [0] once (step 411). Next, it is determined that the image formation on one paper sheet has been completed, and the number counted by the print counter is increased by [1] (step 404).

Thus, in the image forming apparatus 1, before the image formation on the paper is performed, whether or not the widths W3 and W5 are wider than the widths W4 and W6 of the registration adjustment patches is confirmed. In case that the widths W3 and W5 are not wider than the widths W4 and W6, when the registration adjustment is performed (when such the case corresponds to the condition A), the printing operation on the paper is interrupted and the registration adjustment is performed. In case that the widths W3 and W5 are wider than the widths W4 and W6, when the registration adjustment is performed (when such the case corresponds to the condition B), the printing operation on the paper is continued and the registration adjustment is performed.

Further, the image forming apparatus 1 can be constituted not only by the center registration system described with reference to FIG. 2 but also by a corner registration system shown in FIG. 5.

The case where the image forming apparatus 1 is constituted by the corner registration system will be described with reference to FIG. 5.

Figure 5:
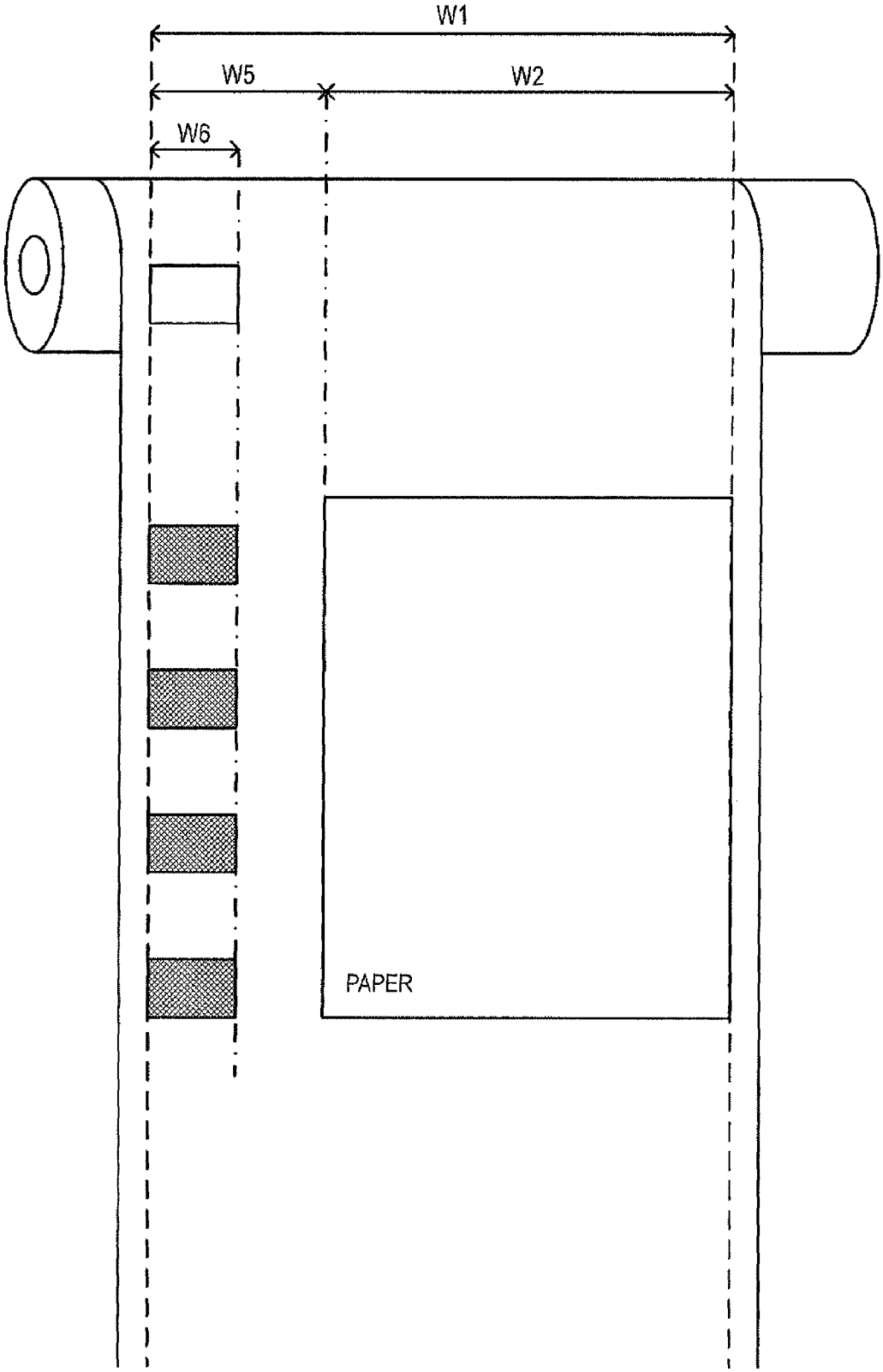
FIG. 5 is a schematic diagram showing a width W5 and a width W6 in a corner registration system.

FIG. 5 is a schematic diagram showing a width W5 and a width W6 in case that the image forming apparatus 1 is constituted by the corner registration system.

In case that the image forming apparatus 1 is constituted by the corner registration system, only the widths W5 and W6 become elements for determination in the step 401, which is different from the case in the center registration system described with reference to FIG. 2.

An unused area in the image formable area W1, which remains unused in printing on the paper, becomes the width W5, and whether or not this width W5 is wider than the width W6 of the registration adjustment patch is determined in the step 401.

Further, since the corner registration system is different from the center registration system in that the area compared in the step 401 is one, as shown in FIG. 5, the area of W5 in the corner registration system becomes wider than that in the center registration system, so that a limit in the width W6 of the registration adjustment patch is small.

In the image forming apparatus 1, although the condition A in case that the printing operation is interrupted and the registration adjustment is performed, and the condition B in case that the printing operation is continued and the registration adjustment is performed adopt the print counter as an element of their conditions, another may be adopted as an element of the conditions.

As an element of the conditions, for example, not the print counter but the amount in change of temperature may be adopted.

Further, as the condition in case that the printing operation is interrupted and the registration adjustment is performed, and as the condition in case that the printing operation is continued and the registration adjustment is performed, one condition is set respectively like the condition A or the condition B. However, according to necessity, plural of conditions can be set.

Further, the image forming apparatus 1 may be constituted as follows: Not the registration adjustment patch for adjusting registration but a patch for process control is formed in the unused are in the image formable area, and whether or not the widths W3 and W5 are wider than widths W4 and W6 of the patches for process control is confirmed by a detection sensor of the process control patch before image formation on the paper is performed. Under this constitution, in case that the widths W3 and W5 are not wider, when the process control is required, the printing operation on the paper is interrupted and the process control is performed; and in case that the widths W3 and W5 are wider, when the process control is required, the printing operation on the paper is continued and the process control is performed.

Further, in the registration adjustment patches described with reference to FIG. 2, though the registration patch for Y-color, the registration patch for M-color, the registration patch for C-color, and the registration patch for K-color are formed in order, the order of the registration adjustment patches of the respective colors and the number of them are limited to the abovementioned. For example, the registration patch for Y-color, the registration patch for K-color, the registration patch for M-color, the registration patch for K-color, the registration patch for C-color, and the registration patch for K-color may be formed in this order.

Further, the image forming apparatus 1 is not limited to the tandem type image forming apparatus of the direct transfer as described with reference FIG. 1, but can be constituted also as a tandem type image forming apparatus of secondary transfer which includes a secondary transfer belt that carries a toner image to transfer its toner image onto paper.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments are chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. An image forming apparatus comprising:

a plurality of image forming units that form toner images in different color;

an image carrier to which the toner image of each color formed by each image forming unit is transferred and which carries the toner image of each color;

a determination unit that determines, in relation to a size of image data instructed to print, whether or not a first area where a misregistration correcting image is formed at an end portion in a width direction of the image carrier is secured;

a control unit that controls the image forming unit, in case that the determination unit has determined that the first area is secured and when a first condition is satisfied, so as to form the misregistration correcting image for correcting a misregistration of the toner image formed by each image forming unit, in a second area on the image carrier where a recording medium is not contacted, while an image formation on the recording medium is not interrupted; and a detection sensor that detects the misregistration correcting image formed on the image carrier by controlling of the control unit, wherein the misregistration of the toner image formed by each image forming unit is corrected on a basis of a value detected by the detection sensor, the control unit controls the image forming unit, in case that the determination unit has determined that the first area is not secured and when a second condition is satisfied, so as to interrupt an image formation on the recording medium and form the misregistration correcting image on the image carrier, the first condition is a first value of a state relating to the image forming apparatus, and the second condition is a second value, greater that the first value, of the state relating to the image forming apparatus.

2. The image forming apparatus according to claim 1, wherein the first and second conditions are related to a number of recording media on which images have been formed.

3. The image forming apparatus according to claim 1, wherein the first and second conditions are related to a change amount in temperature inside of the image forming apparatus.

* * * * *